US007347344B2

(12) United States Patent
Engels et al.

(10) Patent No.: US 7,347,344 B2
(45) Date of Patent: Mar. 25, 2008

(54) APPARATUS FOR DISPENSING A PLURALITY OF FLUIDS AND CONTAINER FOR USE IN THE SAME

(75) Inventors: Marcel Hendrikus Petrus Engels, Voorhout (NL); Bastiaan Albert Simon Peeters, The Hague (NL); Constantijn Thomas Papaikonomou, The Hague (NL)

(73) Assignee: Fluid Management Operation LLC, Wheeling, IL (US)

( * ) Notice: Subject to any disclaimer, the term of this patent is extended or adjusted under 35 U.S.C. 154(b) by 381 days.

(21) Appl. No.: 10/694,485

(22) Filed: Oct. 27, 2003

(65) Prior Publication Data

US 2005/0087545 A1 Apr. 28, 2005

(51) Int. Cl.
*B67D 5/06* (2006.01)

(52) U.S. Cl. ..... 222/144; 222/1; 222/55; 222/77; 222/105; 222/108; 222/135; 222/144.5; 222/385

(58) Field of Classification Search ..... 222/1, 222/135–137, 105, 325, 144, 144.5, 108, 222/385, 103, 463, 55, 52, 77
See application file for complete search history.

(56) References Cited

U.S. PATENT DOCUMENTS 2,630,259 A * 3/1953 Stein et al. ..... 137/170.3
2,923,438 A 2/1960 Logan et al.
3,074,597 A 1/1963 Felts
4,259,372 A 3/1981 Eddy
4,473,173 A 9/1984 DeGroff et al.
4,781,312 A 11/1988 Strazdins
4,871,262 A 10/1989 Krauss et al.
4,928,853 A * 5/1990 Isham et al. ..... 222/108
4,964,534 A 10/1990 Strazdins
4,966,308 A 10/1990 Strazdins
5,083,591 A 1/1992 Edwards et al.
5,163,010 A 11/1992 Klein et al.
5,240,502 A 8/1993 Castaldo et al.
5,311,293 A 5/1994 MacFarlane et al.
5,313,267 A 5/1994 MacFarlane et al.
5,478,238 A 12/1995 Gourtou et al.
5,495,338 A 2/1996 Gouriou et al.
5,622,692 A 4/1997 Rigg et al.

(Continued)

FOREIGN PATENT DOCUMENTS

EP 0843163 A1 11/1996

(Continued)

OTHER PUBLICATIONS

Search Report from the European Patent Office dated May 9, 2005.

*Primary Examiner*—Frederick C. Nicolas
(74) *Attorney, Agent, or Firm*—Miller, Matthias & Hull

(57) ABSTRACT

An apparatus for dispensing a plurality of fluids, comprises a plurality of pumps, having a connector for releasably connecting, to the respective pump, a container, which holds a fluid and comprises a connector-counterpart, and at least one actuator for releasing a container from a connector, which the actuator is adapted to operatively engage the connector-counterpart and, upon engaging this counterpart, pull the same onto the connector and establish a fluid connection between the respective pump and the container.

46 Claims, 7 Drawing Sheets

U.S. PATENT DOCUMENTS

| | | | | |
|---|---|---|---|---|
| 5,624,056 | A | 4/1997 | Martindale | |
| 5,780,018 | A | 7/1998 | Collins et al. | |
| 5,785,960 | A | 7/1998 | Rigg et al. | |
| 5,797,750 | A | 8/1998 | Gouriou et al. | |
| 5,855,626 | A | 1/1999 | Wiegner et al. | |
| 5,862,947 | A | 1/1999 | Wiegner et al. | |
| 5,903,465 | A | 5/1999 | Brown | |
| 5,945,112 | A | 8/1999 | Flynn et al. | |
| 5,950,874 | A | 9/1999 | Sindoni | |
| 5,992,691 | A | 11/1999 | Post et al. | |
| 6,003,731 | A | 12/1999 | Post et al. | |
| 6,024,250 | A | 2/2000 | Hickey | |
| 6,067,504 | A | 5/2000 | MacFarlane et al. | |
| 6,089,408 | A | 7/2000 | Fox | |
| 6,164,497 | A | 12/2000 | Chia et al. | |
| 6,177,093 | B1 | 1/2001 | Lombardi et al. | |
| 6,178,341 | B1 | 1/2001 | Macfarlane et al. | |
| 6,202,895 | B1 | 3/2001 | Fox | |
| 6,269,978 | B1 * | 8/2001 | Sindoni | 222/144.5 |
| 6,273,298 | B1 | 8/2001 | Post | |
| 6,284,228 | B1 | 9/2001 | Markowitz et al. | |
| 6,314,372 | B1 | 11/2001 | Macfarlane et al. | |
| 6,330,341 | B1 | 12/2001 | Macfarlane et al. | |
| 6,338,349 | B1 | 1/2002 | Robinson et al. | |
| 6,402,364 | B1 | 6/2002 | Esclar et al. | |
| 6,412,658 | B1 | 7/2002 | Bartholomew et al. | |
| D461,080 | S | 8/2002 | Bartholomew et al. | |
| 6,437,866 | B1 | 8/2002 | Flynn | |
| D465,810 | S | 11/2002 | Bartholomew et al. | |
| 6,478,235 | B1 | 11/2002 | Soderstrom et al. | |
| 6,502,583 | B1 | 1/2003 | Utsugi | |
| 6,510,366 | B1 | 1/2003 | Murray et al. | |
| 6,516,245 | B1 | 2/2003 | Dirksing et al. | |
| 6,571,003 | B1 | 5/2003 | Hillebrand et al. | |
| 6,615,881 | B2 | 9/2003 | Bartholomew et al. | |
| 6,622,064 | B2 | 9/2003 | Bartholomew et al. | |
| D485,310 | S | 1/2004 | Bartholomew et al. | |
| 6,672,341 | B2 | 1/2004 | Bartholomew et al. | |
| 2001/0047309 | A1 | 11/2001 | Bartholomew et al. | |
| 2002/0010528 | A1 | 1/2002 | Bartholomew et al. | |
| 2002/0081341 | A1 | 6/2002 | Sott | |
| 2002/0082745 | A1 | 6/2002 | Wilmott et al. | |
| 2002/0091596 | A1 | 7/2002 | Dudek et al. | |
| 2002/0095309 | A1 | 7/2002 | Rothschild | |
| 2002/0130442 | A1 | 9/2002 | Statham et al. | |
| 2002/0131985 | A1 | 9/2002 | Shana'a et al. | |
| 2002/0179639 | A1 | 12/2002 | Bartholomew et al. | |
| 2002/0194021 | A1 | 12/2002 | Matsumoto et al. | |
| 2003/0060925 | A1 | 3/2003 | Bartholomew et al. | |
| 2003/0062379 | A1 | 4/2003 | Bartholomew et al. | |
| 2003/0069667 | A1 | 4/2003 | Dirksing et al. | |
| 2003/0090176 | A1 | 5/2003 | Bartholomew et al. | |
| 2003/0120534 | A1 | 6/2003 | Giacchetti et al. | |
| 2003/0230355 | A1 | 12/2003 | Bartholomew et al. | |

FOREIGN PATENT DOCUMENTS

| | | | |
|---|---|---|---|
| EP | 1260435 | A1 | 2/1998 |
| EP | 0992450 | A1 | 4/2000 |
| EP | 1167930 | A1 | 6/2000 |
| EP | 1090679 | A1 | 4/2001 |
| EP | 0800858 | B1 | 7/2002 |
| EP | 1134186 | B1 | 5/2003 |
| EP | 0788831 | B1 | 11/2003 |
| WO | WO 01-75586 | A1 | 10/2001 |
| WO | WO 03-026458 | A2 | 4/2003 |
| WO | WO-03/031161 | A1 | 4/2003 |
| WO | WO-03/031280 | A1 | 4/2003 |
| WO | WO-03/083334 | A1 | 10/2003 |
| WO | WO-2005/039747 | A2 | 5/2005 |

* cited by examiner

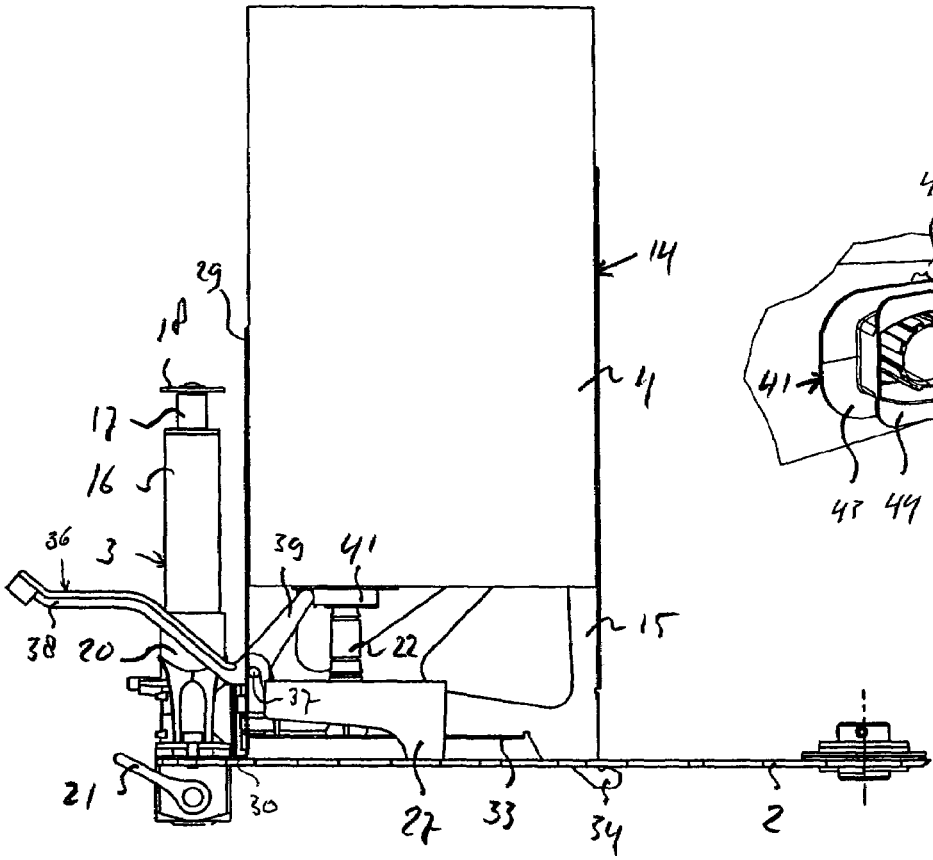
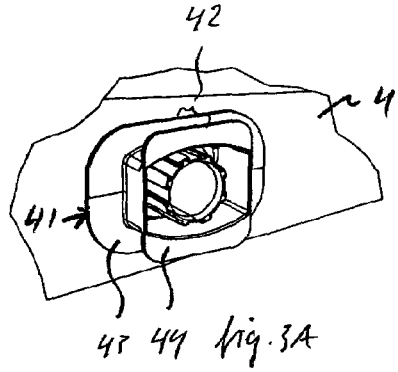
fig. 3A
fig 3
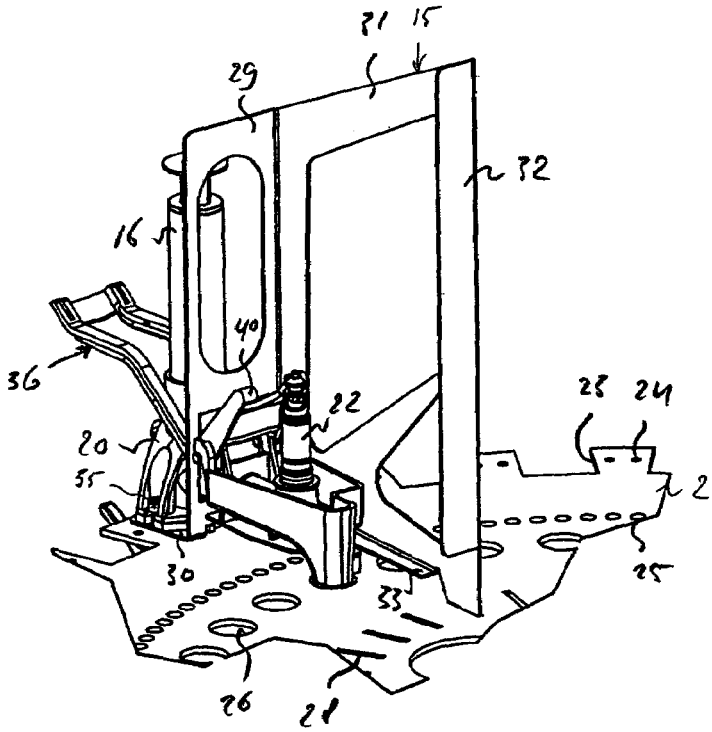
fig. 4

APPARATUS FOR DISPENSING A PLURALITY OF FLUIDS AND CONTAINER FOR USE IN THE SAME

BACKGROUND

1. Technical Field

An apparatus for dispensing a plurality of fluids is disclosed which comprises a plurality of pumps connected or connectable to respective containers holding a fluid or suitable for holding a fluid.

2. Background of the Related Art

A prior art apparatus of this type is disclosed in European Patent Application No. 1 090 679. This document relates to an apparatus for dispensing viscous fluids comprising a turntable (numeral 2 in inter alia figures 10a to 10e) rotatable around an axis of rotation. A plurality of containers (1) containing the fluid to be dispensed are attached to the turntable in positions spaced about the circumference of the turntable. A pump (17) is associated with each container for dispensing fluid therefrom. The pumps have connectors (6) for releasably connecting the containers to the pumps. A stationary actuator (38) is positioned at the circumference of the turntable and is movable to and fro a first inoperative position disengaged from the turntable, a first operative position in engagement with one of the connectors, in which the connector is connected to the respective container, and a second operative position, in which the connector is disengaged from the container and the container may be removed and exchanged for another container.

European Patent Application No. 1 134 186 relates to a dispensing device wherein the pumps each have a connector for releasably connecting a fluid package thereto and have associated first positioning members. A plurality of removable rigid holders is adapted to receive a flexible fluid package therein in a predetermined position. The holders include second positioning members adapted to co-act with the first positioning members to enable placement of the holders onto the turntable such that the package received therein is connected to the respective connector. A lifter (12) with a handle (13) is arranged about each of the first positioning members, said lifter being able to exert an upward force onto the lower side of a mounted holder when the handle (13) is depressed.

U.S. Pat. No. 5,083,591 relates to an automated paint-batching system for producing paint cans of any size and color. The system includes a plurality of paint-batching cells, with each cell having a machine comprised of either one or two dispensing stations (16, 18). When two dispensing stations are used, the two dispensing stations are: a first tint-station (16), where a small volumetric dispensing of the base, water-base or oil-base, of the paint is dispensed, in order to wet the bottom of the can, at which first station, thereafter, is dispensed all of the liquid colorants making up the formula of the paint can, and a second base-dispensing station (18) at which the remainder of the base of the formula of the paint is dispensed. Each of the first and second stations of the paint-batching machine of the invention has operatively associated therewith a weighing mechanism (70) upon which rests the paint can during the dispensing at the respective station used in quality-control weighing of each dispensing.

SUMMARY OF THE DISCLOSURE

An apparatus for dispensing a plurality of fluids is disclosed that comprises a plurality of pumps, having a connector for releasably connecting, to the respective pump, a container, which holds a fluid and comprises a connector-counterpart, and at least one actuator for releasing a container from a connector, which actuator is adapted to operatively engage the connector-counterpart and, upon engaging this counterpart, pull the same onto the connector and establish a fluid connection between the respective pump and the container.

By engaging the connector-counterpart, containers can be reliably installed, even by personnel with limited training, and leakage or dripping can at least be reduced.

It is preferred that at least some of the pumps, preferably all of the pumps, are associated with such an actuator. It is further preferred that the actuators comprise a lever mounted on a pivot axis associated with a respective pump, which lever comprises an operating handle on one side of the pivot axis and at least one arm for operatively engaging the connector-counterpart on the other side of the pivot axis. If, upon establishing a fluid connection between the respective pump and the container, the handle extends substantially parallel to the pump and/or the container, the handle takes up only little space.

An apparatus for dispensing a plurality of fluids is disclosed that comprises a plurality of volumetric metering pumps, connected to a container or having a connector for releasably connecting a container to the respective pump, and a weighing device for measuring the weight of the fluid dispensed by the pumps.

It is preferred that the apparatus further comprises a device, e.g. a data processing device comprising a memory, for storing at least one parameter, preferably dispensed volume or volume to be dispensed, indicative of the required accuracy of the weight measurement to be carried out and wherein the length of the time interval during which the weight measurements are carried out is selected depending on the stored parameter.

It is further preferred that the at least one parameter is indicative of the amounts that have been dispensed by each of at least some, preferably all, of the pumps and/or from each of at least some, preferably all, of the containers.

An apparatus for dispensing a plurality of fluids is disclosed that comprises a plurality of pumps, connected to a container or having a connector for releasably connecting a container to the respective pump, wherein a receptacle is positioned beneath and/or around at least some of the connectors and/or containers, preferably all of the connectors and/or containers, to collect fluid leaking or dripping from a respective connector and/or container.

Thus, if, despite other measures, leakage or dripping does occur, the resulting effects are contained. Such containment is significant both at a hairdresser or a beautician, who wants to keep respectively her/his salon or spa clean and tidy, and at a retailer of decorative paints or in an industrial environment, e.g. involving car refinishes, where leakage or dripping necessitates frequent maintenance.

It is preferred that the lower wall of the receptacle or a portion of the lower wall is inclined and that the lower wall comprises an opening for letting through collected fluid.

It is further preferred that a shared receptacle is positioned beneath the said receptacles to collect fluid dripping from these receptacles.

An apparatus for dispensing a plurality of fluids is disclosed that comprises a support, such as a turntable or a linear table, and a plurality of pumps, connected to a container or having a connector for releasably connecting a container to the respective pump, and, if the container is releasable, a guide for receiving and accommodating a container mounted on the support, wherein each combination of a pump, a connector, and a container or guide is formed as a module which, as a whole, is releasably mounted on the support.

Such a module facilitates ready replacement, reducing downtime and/or avoiding or reducing the necessity of on-the-spot repair or maintenance.

It is preferred that at least some of the modules, preferably all of the modules, comprise a front portion and a rear portion, the front portion comprising a releasable fastener and the rear portion comprising an extension or recess, whereas the support comprises a plurality of respectively recesses and extensions for operatively engaging an extension or recess on a module.

It is further preferred that at least some of the pumps, preferably all of the pumps, comprise an actuator for releasing, and preferably also pulling, a container from, respectively onto, the connector and that the actuator is part of the module.

It is further preferred that a receptacle is positioned beneath or around at least some of the connectors, preferably all of the connectors, to collect fluid leaking or dripping from a respective container and that the receptacle is part of the module.

An apparatus for dispensing a plurality of fluids is disclosed that comprises a turntable and a plurality of pumps, connected to a container or having a connector for releasably connecting a container to the respective pump, the pumps and containers or connectors being mounted on the turntable arranged along the circumference of the turntable or part of the circumference of the turntable, wherein at least one of the containers has a larger volume than the other containers or is in fluid connection with a further container positioned towards or at the centre of the turntable.

It is preferred that the front portions of the containers are positioned at or near the circumference of the turntable, and that the rear portion of the at least one larger container extends beyond the rear portions of at least some of the other containers.

It is further preferred that the apparatus comprises one or more, preferably two or more, larger containers and that the rear portions of the containers are complementary in shape with respect to each other and/or with respect to the rear portions of the other containers.

It is further preferred that the rear portions of the larger containers take up substantially all of the space defined by the rear portions of the other containers.

It is further preferred that the apparatus comprises two or more larger containers, which are substantially evenly distributed, either individually or group wise, over the circumference of the turntable.

A container for use in the above-mentioned apparatus is disclosed, which container comprises a connector-counterpart provided with at least one rail or slot.

It is preferred that the container is a bag-in-box container and that the outer surface of the container is made of paper or cardboard.

Within the framework of this disclosure, the term "fluid" is defined as any material that can flow and that can be dispensed by the apparatus according to the present invention. Examples of fluids include liquids, pastes, granulates, and powders.

As a result, a reliable apparatus for dispensing a plurality of fluids, wherein depleted containers can be easily and reliably replaced by filled containers.

Further, the disclosed apparatus prevents or at least reduces leakage or dripping of the container and, if such leakage or dripping does occur anyway, to contain the effects thereof.

The disclosed apparatus also facilitates ready replacement of the pumps and/or of components associated with the pumps.

Further, the frequency with which certain containers have to be replaced or refilled is reduced.

BRIEF DESCRIPTION OF THE DRAWINGS

FIGS. 3 to 6 are side views and perspective rear views of a pump-module of the apparatus in FIG. 1 and in accordance with the disclosure;

FIG. 3A is a perspective view of a connector-counterpart used in the apparatus of FIG. 1;

It is noted that the drawings are not necessarily to scale and that details, which are not necessary for understanding the present invention, may have been omitted. The terms "upper", "lower", "horizontal", "vertical", "front", "rear", and the like relate to the embodiments as oriented in the figures. Further, elements that are at least substantially identical or that perform an at least substantially identical function are denoted by the same numeral.

DETAILED DESCRIPTION OF THE PRESENTLY PREFERRED EMBODIMENTS

Figure 1:
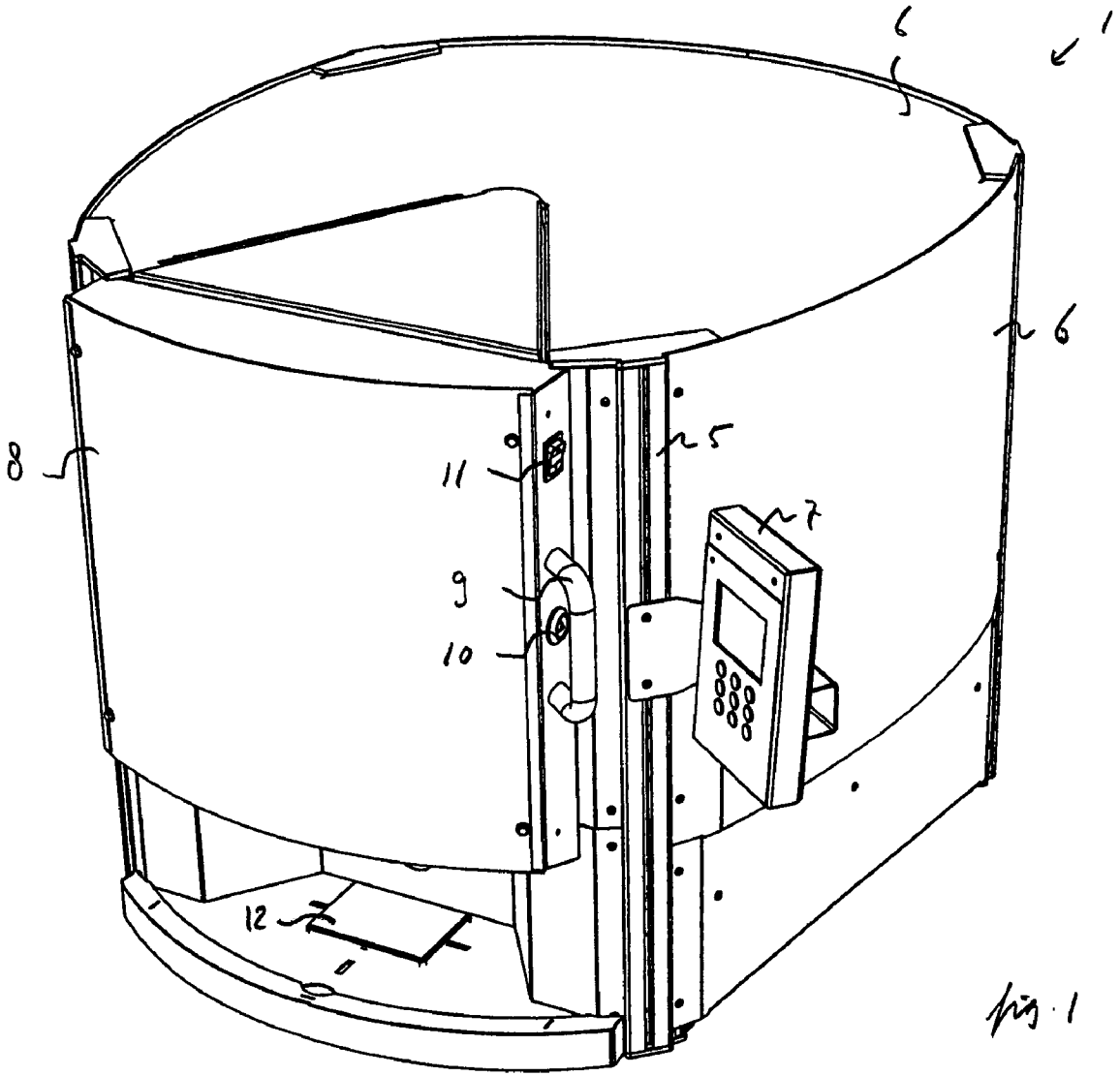
FIG. 1 is a perspective view of a disclosed apparatus for dispensing fluids.
Figure 2:
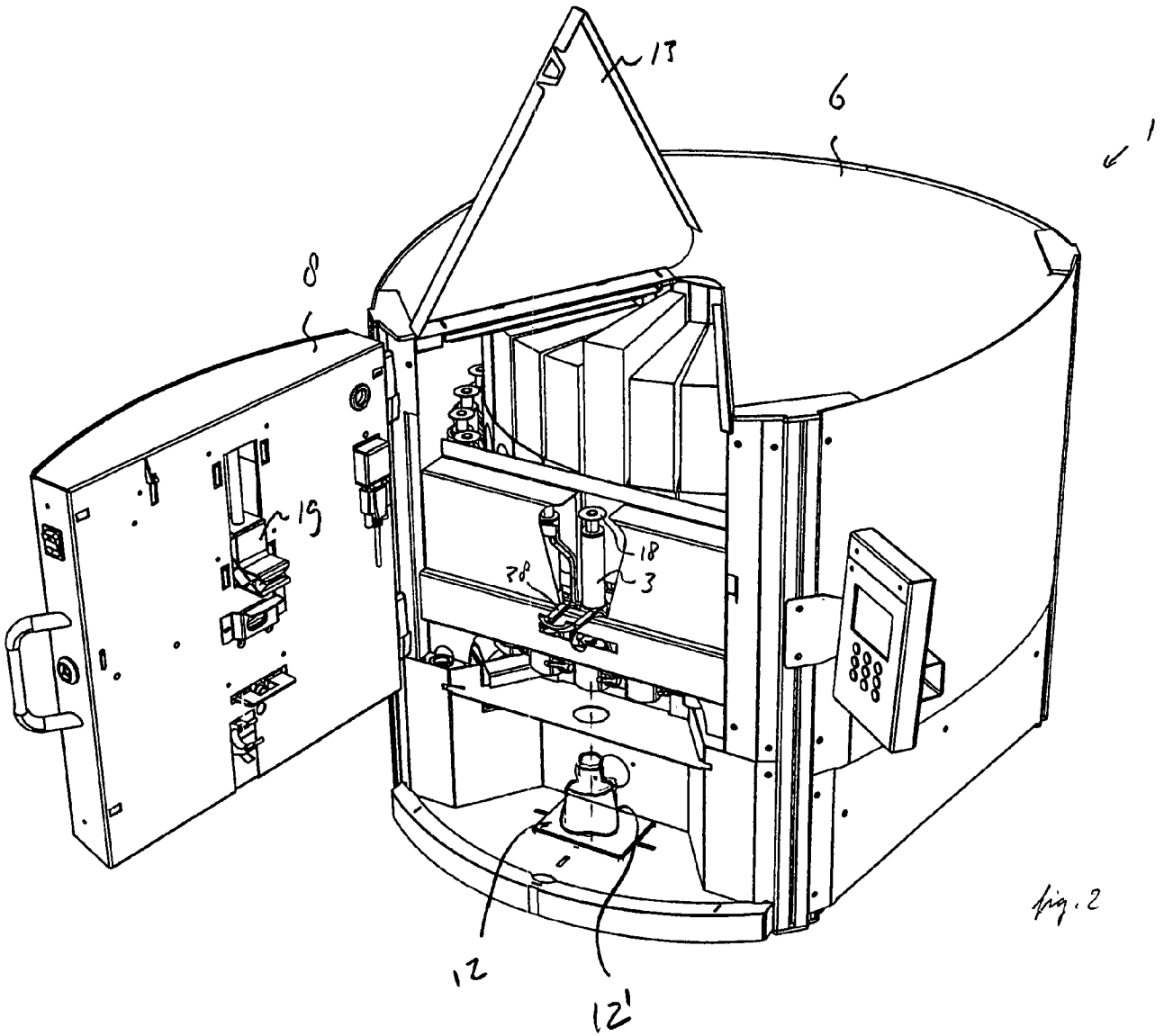
FIG. 2 is a perspective view of the apparatus in FIG. 1 with its internals partially exposed.
Figure 5:
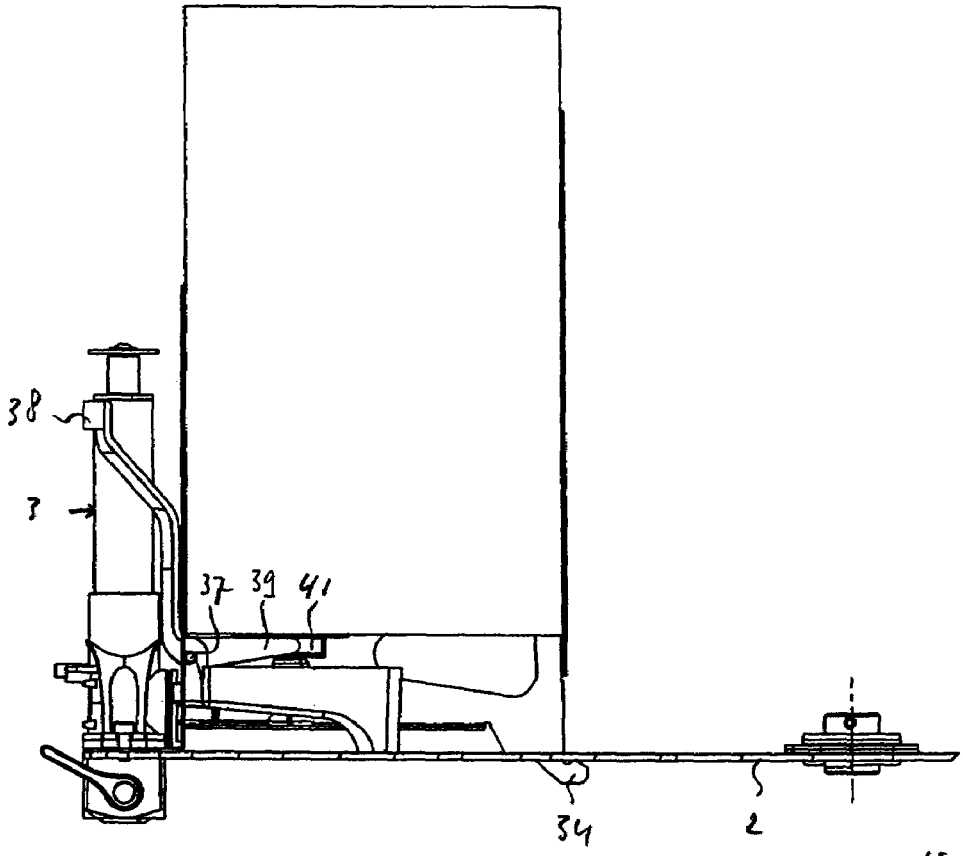

FIGS. 1 and 2 illustrate an example of an apparatus 1 for dispensing a plurality of fluids, such as (components of) paints, paint colorants, hair dyes, shampoos, foundations, and the like. It can be used for dispensing numerous recipes of the said products and can be located e.g. at a retailer of decorative paints, a hairdresser, or a spa, respectively.

This particular dispensing apparatus 1 is an automated version and includes a horizontal turntable 2 (best shown in FIG. 7), with a plurality of metering pumps 3 and bag-in-box containers 4 mounted along its circumference. The turntable 2 can be rotated between discrete positions, e.g. thirty-two positions including a front or dispensing position (marked in FIG. 2 by a slightly raised container), about a vertical, central axis by means of a drive (not shown).

The apparatus 1 includes a frame 5 of e.g. aluminium extrusion profiles on which sheets 6 of metal or a polymer (transparent, translucent or opaque) have been attached by means of e.g. screws. A control panel 7 comprising a display and a small keyboard for entering information, such as customer data and recipes, is mounted on the right hand side of the frame 5, next to a door 8. This door 8 contains a computer for storing the said information and for driving the turntable 2, actuators for operating the pumps 3, etc., and is further equipped with a handle 9, a lock 10, and a switch 11 for turning the apparatus 1 on or off. A weighing device 12 is positioned below the door 8 in a recess where a cup or the like for receiving fluids dispensed by the apparatus 1 can be placed.

A substantially triangular hatch 13 is pivotally mounted, along one of its rims, in the top sheet 6. The hatch 13 is locked in place by the upper rim of the door 8. Opening the door 8 and the hatch 13 reveals a plurality of modules 14 (clearly shown in e.g. FIGS. 3 to 6), releasably mounted in a circle on the turntable 2.

As can be seen in FIGS. 3 to 6, each of the modules 14 comprises a guide member 15 of sheet metal or a synthetic material, which also serves as a frame on which inter alia one of the mentioned metering pumps 3 is mounted. Pumps 3 of this type are known in the art and comprise, at least in this example, a cylinder 16, which communicates with one of the mentioned bag-in-box containers 4 (shown in FIGS. 2, 3, and 5). The pumps 3 further comprise a piston, mounted inside the cylinder 16 and provided with a piston rod 17, which, on its upper end, is provided with a washer or flange 18. To reduce the number of strokes necessary for dispensing relatively large quantities of e.g. hair dye components, it is preferred that the cylinders 16 are sufficiently large, i.e. enable a stroke of at least 20 ml, e.g. 30 ml.

When the door 8 is closed, an actuator 19 on the inside of the door 8 engages the flange 18 of the pump 3 that is in the front position. The actuator 19 is shaped like a claw, which allows unobstructed horizontal movement of the pumps 3, but engages, when it moves vertically, the flange 18 and hence the piston rod 17 and the piston of the respective pump 3 in front of it. Upward movement of the actuator 19 causes an intake stroke of the piston and downward causes a discharge stroke.

The cylinder 16 is mounted in the top part of a pump housing 20, containing a known valve member, e.g., a ball valve or a cylindrical valve, which can be operated by means of a lever 21. In the intake position of this lever 21, the cylinder 16 communicates, via a connector 22, with a container 4 and can be filled with a desired amount of the fluid from the container 4 by moving the flange 18 upwards over a desired or predetermined length. As soon as a selected amount of fluid has been taken in, the valve member can be rotated to a dispensing position. In this position, the cylinder 16 communicates with a dispensing opening in the bottom surface of the pump housing 20 and the fluid can be dispensed by moving the flange 18 downwards.

Details regarding the turntable, pumps and the procedure for driving these components, are disclosed in, for instance, International application WO 03/083334, European patent application 0 992 450, and European patent application 0 800 858, which are incorporated herein by reference.

Figure 6:
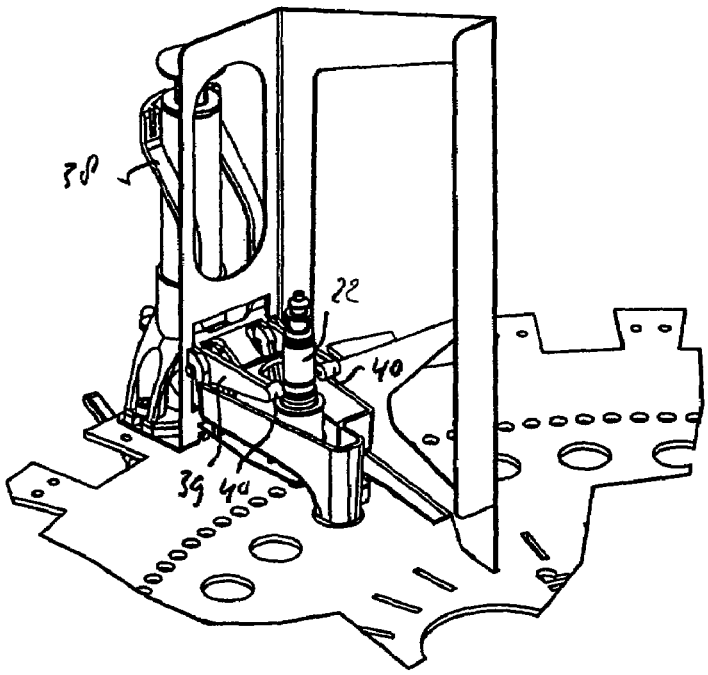

As can be seen in FIGS. 4 and 6, the turntable 2 comprises along its circumference square recesses 23 for receiving the pump housings 20, which recesses 23 are flanked on either side by threaded screw holes 24. The turntable 2 is further provided with a ring of small holes 25, which allow the turntable 2 to be rotated by means of one or more electric motors positioned beneath the turntable 2 and each provided with a wheel (not shown) comprising protrusions, which correspond in size and mutual distance to the said small holes 25. Further towards the central axis of the turntable 2 drip holes 26 are provided, which are in register with small receptacles 27 that will be discussed in more detail below. Still further towards the central axis of the turntable 2, radially extending slots 28, also discussed below, are provided as well as five relatively large holes in a circle, which serve to reduce the weight of the turntable 2 and hence of the apparatus 1.

As mentioned, each of the modules 14 comprises a guide member 15, which also serves as a frame. The member 15 comprises a front wall 29 provided with a foot 30 extending horizontally and in forward direction. The foot 30 supports a pump housing 20 and is provided with two through holes. The guide member 15 further comprises a sidewall 31 and rear wall 32, which together with the front wall 29 and the sidewall of an adjacent module 14 provide a guide for a container 4. The sidewall 31 has an inclined upper rim, which facilitates inserting a container 4, and a bent lower rim 33, which carries a connector 22 and a receptacle 27 surrounding the connector 22.

The rear wall 32 of the module 14 comprises an extension 34 extending below the module 14 and beyond the rear wall 32. A module 14 can be quickly secured to the turntable 2 by inserting the extension 34 in one of the slots 28 at an angle with the turntable 2 and, once the extension 34 has been inserted, rotating the module 14 downwards until the foot 30 rests on the turntable 2 and the through holes in the foot 30 and the pump housing 21 are in register with the threaded screw holes 24 in the turntable 2. The module 14 can then be fastened to the turntable 2 by means of bolts 35. As a matter of course, the front portion of the modules 14 can also be fastened to the turntable with e.g. a clamping device, a sufficiently strong magnet, a snap-fit construction, through friction, etc.

In case of a malfunction of one of the components of one of the modules, that module can be removed and replaced quickly and can be repaired or serviced elsewhere.

Each of the modules 14 is provided with an actuator, preferably a lever 36 made e.g. of metal or a synthetic material and mounted pivotably, by means of an axis 37 welded to the lever 36 and positioned between the front wall 29 of the module 14 and the receptacle 27 or snapped-fitted in recesses in the receptacle 27, and extending parallel to a tangent of the turntable 2. The lever 36 comprises a relatively long and substantially U-shaped operating handle 38 on one side of the pivot axis 37 and two relatively short parallel arms 39 on the other side of the pivot axis 37 extending at an angle of about 90 degrees with respect to the handle 38. The arms 39 are provided with round protrusions 40 extending inwardly.

Each of the bag-in-box containers 4 includes a connector-counterpart 41 (FIG. 3A), which is part of the bag and extends through and opening in the bottom wall of the box. The counterpart 41 includes two straight rails 42 extending parallel to each other and to the bottom wall of the box. The upper walls 43 of the rails 42 are longer than the lower walls 44, such that, when a container 4 is placed in the guide member 15 while the handle 38 is in a forward position and the arms 39 consequently extend upwards, the upper walls 43 abut the protrusions 40 on the arms 39. By pushing the container 4 slightly further into the guide member 15, the arms 39 are pushed slightly downwards—and the handle 38 slightly upwards—and the protrusions 40 engage or are at least positioned over the lower walls 44 of the rails 42. From there, the counterpart 41 and the container 4 can be pulled downwards by simply pushing the handle 38 towards the module 14 until a secure fluid connection has been established. Further, the container 4 can be removed by pulling the handle 38 away from the module 14. Upon establishing a fluid connection between the respective pump and the container, the handle extends substantially parallel to the pump and the container. I.e., a relatively long handle can be employed, yielding a relatively low operating force, without necessitating a more voluminous design of the apparatus 1.

The protrusion(s) can be provided with a friction reducing material, such as Teflon, or with a wheel or bearing. However, in this example, the connector-counterpart was made of an injection moulded low friction material, viz. polyethylene.

More details and suitable non-limitative variants of the connectors and connector-counterparts are disclosed in, for instance, International patent applications WO 03/031161 and WO 03/031280, which are incorporated herein by reference.

As mentioned above, the apparatus shown in the figures comprises a weighing device 12 for measuring the weight of fluid dispensed by one or more of the pumps 3. This device can inter alia be used to check whether the correct amounts of each of the components of a certain recipe that should have been dispensed were actually dispensed.

The weighing device 12 in this example comprises a plate (shown in FIG. 1 and 2 on which a cup 12' or the like (i.e., product container 12') can be placed (see FIG. 2). The plate is mounted on a load-cell (hidden from view and known in itself), e.g. a slotted aluminium bar provided with one or more, e.g. four, strain gauges. The change in resistance of the strain gauges is measured and fed, via an amplifier, and optionally a low pass filter, into the computer in the door 8 of the apparatus and processed (e.g. filtered). In practice, an accurate measurement may require several seconds, during which interval the influence of vibrations in the apparatus itself or from external sources is filtered out.

According to an aspect of the disclosure, the time needed for dispensing a recipe can be reduced as follows. The computer stores information on the volumetric amounts that have been dispensed by the pumps 3 from each of the containers 4 and on the amount of fluid that, based on this volumetric information and the density of the respective fluid, should still be present in each of the containers 4. As long as this amount is above a suitable threshold value, e.g. 10% of the volume of a filled container, the weight measurements are carried out quickly and/or the turntable 2 is already rotated to its next position during measurement thus reducing the overall time needed to prepare a specific paint, hair dye, or the like.

If the result of the measurement is within an expected range, the dispensing process continues. If the result is outside this range and e.g. too little fluid has been dispensed, the turntable 2 returns to its previous position, a retry is executed, and/or the operator is warned. In such a case, a container 4 may have been installed incorrectly, resulting in an inadequate fluid connection, or the container 4 may have been depleted unexpectedly, and the container 4 should respectively be installed properly or replaced by a filled container 4.

As soon as the amount that should, according to the volumetric data, still be present in a particular container 4 is lower than the said threshold value or the measurement should be more accurate for another reason, e.g. because the amount to be dispensed is relatively small, the time used for weight measurements relating to that container is lengthened to an interval that is sufficient for a more accurate measurement. If it appears, based on this measurement, that the container 4 has been depleted, the operator is warned and the container 4 should be replaced by a filled container 4.

Also, because this system checks whether the correct amounts of fluid have been dispensed, there is no longer a need to replace the containers before they are effectively empty. In other words, the amount of fluid still present in a container when it is replaced, i.e. the amount of waste, can be reduced.

Apart from improving reliability and reducing waste, the weighing device according to the present invention can also be used, e.g. during installation of the dispensing apparatus, to measure the density of the fluids and/or to calibrate the dispensing action of one or more, preferably all, of the pumps.

If the density of one or more of the fluids is not known, this density can be determined by dispensing a pre-selected amount, e.g. equal to the amount obtained with one stroke of a piston pump, and accurately measuring the weight of the dispensed amount. Dividing the measured weight by the dispensed volume yields a value for density, which can be inputted in the above-mentioned computer.

Although most pumps, e.g. piston pumps, dispense linearly, i.e. the amount dispensed is proportional to e.g. the stroke of the piston, non-linear behaviour may occur when small amounts are being dispensed. The apparatus according to the present invention can be calibrated by determining the smallest amount of fluid that is likely to be dispensed, e.g. 0.1 ml, and repeatedly, preferably from three to eight times, dispensing an amount slightly smaller than the determined amount, e.g. 0.8 ml, and weighing the dispensed amounts. This procedure is preferably followed by, repeatedly, again preferably from three to eight times, dispensing an amount e.g. two or three times larger than the previous amount, i.e. respectively 1.6 or 2.4 ml, weighing the dispensed amounts and repeating this last step one ore more time, i.e. with 3.2 or 7.2 ml and so on. By calculating the mean value and standard deviation of the dispensed weights for each volume (0.8, 1.6, 3.2, etc.) and, if the standard deviations are sufficiently small, storing the mean values in the computer e.g. in matrix or table linking the mean values to the respective stroke lengths of the pumps, the pumps can be driven accurately, even in a volume range where the pumps exhibit non-linear behaviour, by means of the said matrix or table preferably supplemented with linear interpolation to calculate values in between the mean values.

Figure 7:
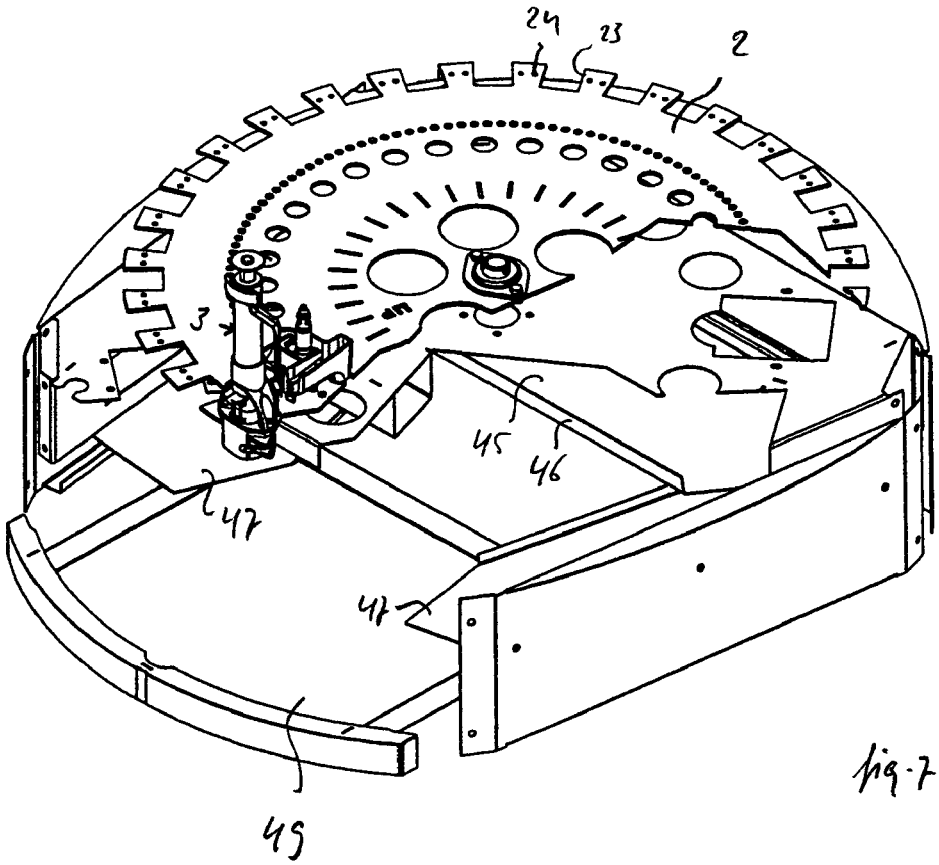
FIGS. 7 to 9 are a perspective side view and sectional front and side views of a receptacle in the apparatus in FIG. 1 and in accordance with the disclosure.
Figure 8:
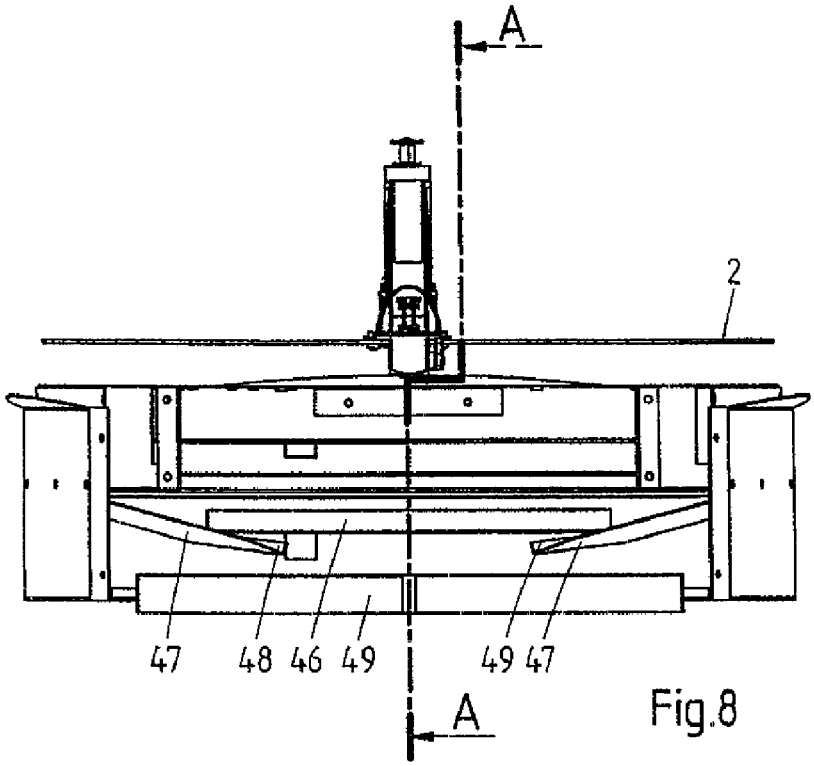
Figure 9:
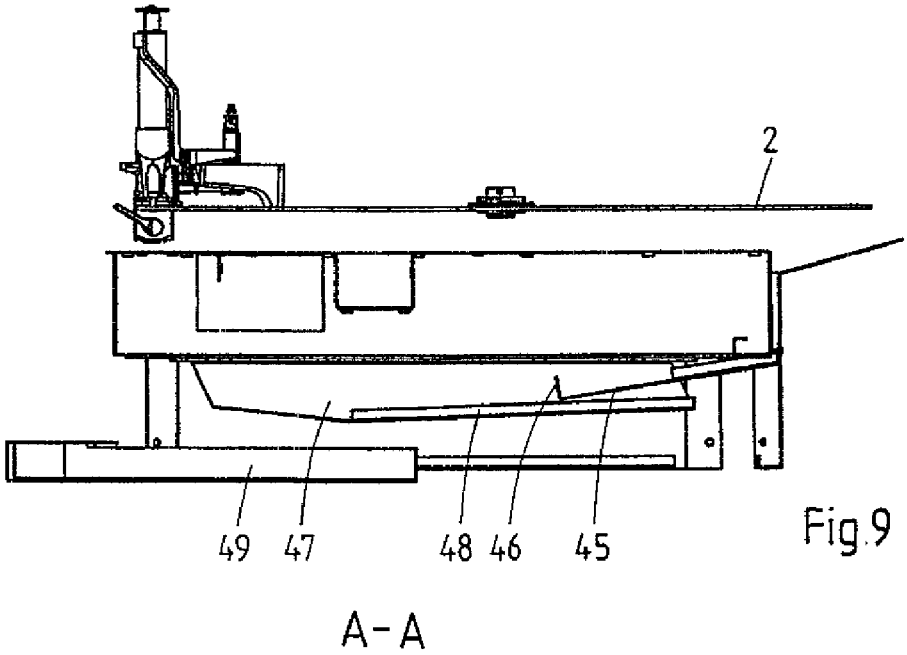

Each of the connectors 22 is surrounded by a receptacle 27 shaped as a funnel. The opening in the bottom of each of the receptacles 27 extends through one of the above-mentioned drip holes 26 in the turntable 2. A shared receptacle, depicted in FIGS. 7 to 9, is positioned beneath the said receptacles 27 to collect fluid dripping from these receptacles 27. The shared receptacle comprises an inclined first plate 45 made of sheet metal or a synthetic material, e.g. ABS, and positioned beneath a number of the said receptacles 27, in this example beneath roughly 50 percent of the receptacles 27. The first plate 45 includes a bent raised edge 46 along it lower rim. Inclined second plates 47, also made of sheet metal or a synthetic material and also including a bent raised edge 48 along respective lower rims, are positioned beneath each of the ends of the raised edge 46 of the first plate 45 and beneath further receptacles. A drawer 49, also made of sheet metal or a synthetic material, is positioned beneath the lower ends of the raised edges 48 of the second plates 47. Thus, the first and second plates 45, 47, and the drawer 49 together provide an effective common receptacle, which follows the circumference of the turntable 2 such that fluid dripping from any one of the receptacles 27 will be collected by at least one of the said plates 45, 47, and eventually the drawer 49.

In many dispensing apparatuses, some components will be dispensed in larger amounts than others. E.g. when making decorative paints, a base paint or specific colorants make up a larger part of most common recipes than others. In hair dyes, a developer is a component of most recipes and, consequently, larger amounts of such a developer are required.

Figure 10:
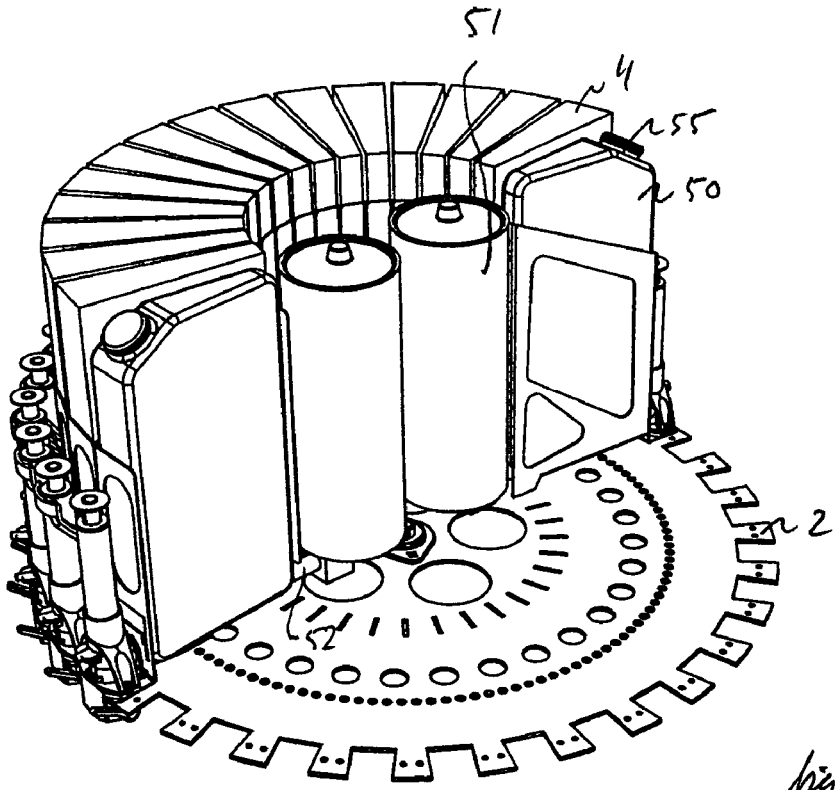

One variant of the present dispensing apparatus, shown in FIG. 10, comprises dedicated containers 50 of a blow moulded synthetic material or made of thin sheet metal, e.g. stainless steel, for the said developer. Each of these containers 50 is in fluid connection with an additional container 51 positioned towards the centre of the turntable 2. The containers 50, 51 function as communicating vessels by means of a duct 52 connecting the bottom walls of these containers 50, 51.

Figure 11:
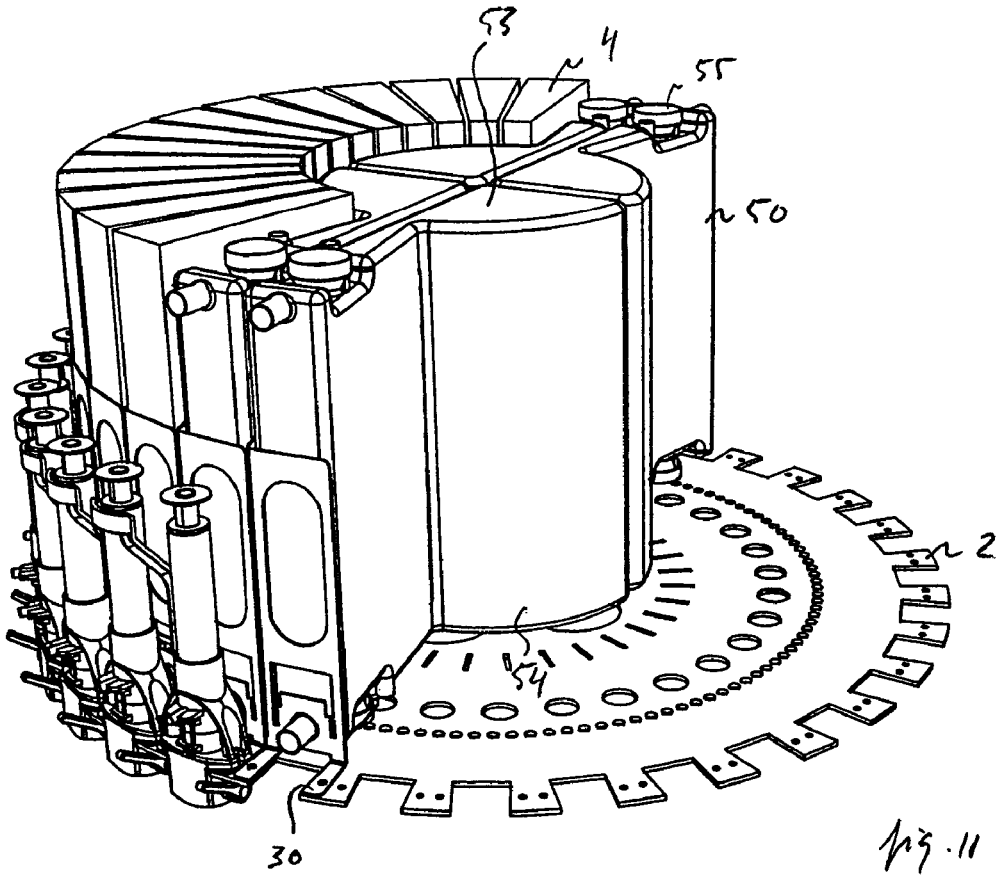

A further variant, shown in FIG. 11, comprises a number of larger containers 50, in this example four larger containers 50, each having a rear portion 53 extending beyond the rear walls of the other containers 4 and comprising two tapering walls and a partially circular wall 54 spanning a quarter of a circle. The rear portions 53 of the larger containers 50 are thus complementary in shape with respect to each other and with respect to the other containers 4 and take up substantially all of the space defined by the rear portions of the other containers and provide almost maximum additional fluid holding capacity. A filler opening, closed by means of a screw cap 55, is provided in a front portion of each of the containers 50.

If it is desirable or necessary to have the developer present in different percentages, each of the containers 50 can be used for one specific percentage, e.g. 3, 6, 9, and 12 percent, or 18 percent in two diametrically opposed containers and 0 percent (for dilution) in the other two diametrically opposed containers.

Figure 12:
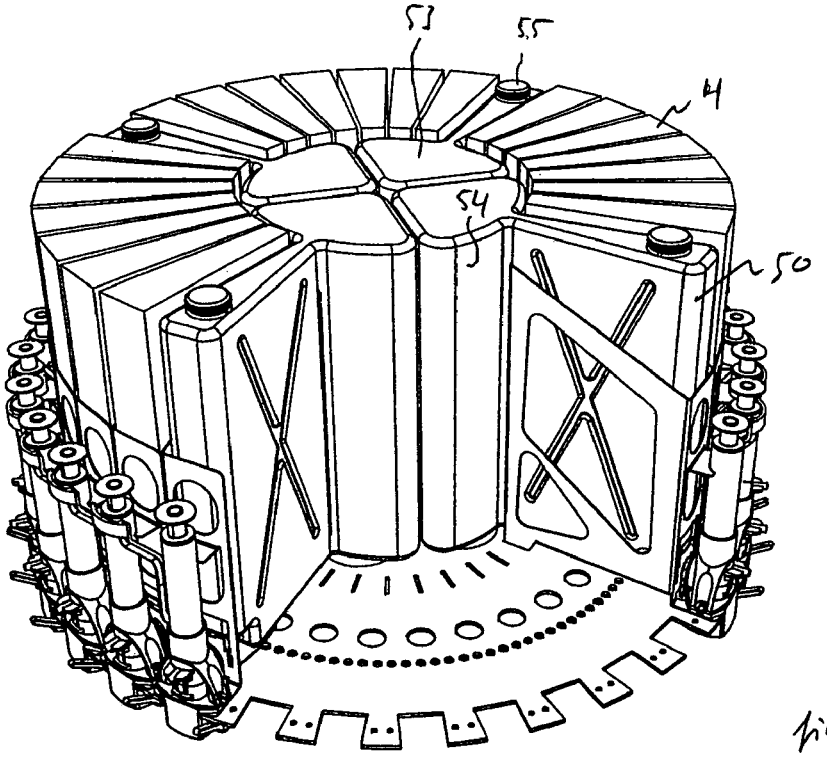
FIGS. 10 to 12 are perspective views of three types of developer containers for use in the apparatus in FIG. 1.

A still further variant, shown in FIG. 12, differs from the variant shown in FIG. 11 primarily in that the front and rear portions of the container 50 are connected halfway the partially circular wall 54. As a result, the containers 50 are located at, in this case, four positions 90 degrees apart. During filling, only one of the containers 50 can be in the front position and only the filler opening of the container 50 in the front position is accessible. Thus, the chance of filling the containers 50 with a wrong fluid, e.g. a wrong strength of peroxide, is reduced.

As a matter of course, this disclosure is not restricted to the above-disclosed embodiments, which may be varied in different manners within the spirit and scope of the invention. For example, the apparatus according to the present invention can be configured as a linear dispensing apparatus i.e. with the containers aligned is a row.

What is claimed is:

1. An apparatus for dispensing a plurality of fluids, the apparatus comprising:

a plurality of pumps, each pump having a connector for releasably connecting a container to said each pump, each container holding a fluid and comprising a connector-counterpart, at least one pivoting actuator lever for both releasing said each container from its respective connector and for pulling said each container onto said respective connector and establishing a fluid connection between said each pump and said each container, the at least one pivoting actuator lever being mounted on a pivot axis, the pivoting actuator lever comprising an operating handle on one side of the pivot axis and at least one arm for operatively engaging the connector-counterpart on an opposing side of the pivot axis.

2. The apparatus of claim 1, wherein at least some of the pumps are associated with the pivoting actuator lever.

3. The apparatus of claim 1, wherein, upon establishing said fluid connection between said each pump and said each container, the handle extends substantially parallel to the pump and/or the container.

4. The apparatus of claim 1, wherein, the connector-counterpart comprises at least one rail or slot and the said arm comprises at least one protrusion adapted to engage the rail or slot.

5. The apparatus of claim 1, wherein the connectors are mounted on a turntable and arranged in a circle or part of a circle.

6. The apparatus of claim 5, further comprising a weighing device disposed tangentially to the turntable but vertically below the turntable, the weighing device providing a surface for supporting a product container to be at least partially filled with at least some of the plurality of fluids, the weighing device measuring a weight of each fluid dispensed into the product container.

7. The apparatus of claim 6, wherein the weighing device communicates signals indicative of the weight of said each fluid dispensed into the product container to a computer.

8. The apparatus of claim 7, wherein the computer verifies that said each fluid intended to be dispensed was dispensed and that correct amounts of said each fluid dispensed into the computer were actually dispensed.

9. A container for use in the apparatus of claim 1, wherein the container is a bag-in-box container and at least part of an outer surface of the container is made of paper or cardboard.

10. An apparatus for dispensing a plurality of fluids, comprising:

a plurality of volumetric metering pumps, each pump is connected to a container or having a connector for releasably connecting said container to said each pump, and a weighing device for measuring a weight of a fluid dispensed by the pumps, wherein each container is a bag-in-box container and comprises a connector-counterpart fixed to the bag, each box comprises an opening for accommodating the connector-counterpart the connector-counterpart comprises a rim comprising a groove or at least one recess, and wherein the rim of the opening in the box is positioned in the said groove or at least one recess.

11. The apparatus of claim 10, which further comprises a data processing device comprising: a memory for storing at least one parameter indicative of a required accuracy of a weight measurement to be carried out and wherein a length of a time interval during which the weight measurements is carried out is selected depending on a stored parameter.

12. The apparatus of claim 11, wherein the at least one parameter is indicative of an amount that has been dispensed by at least one pump.

13. The apparatus of claim 10, wherein the weighing device communicates signals indicative of the weight of said fluid dispensed into the product container to a computer.

14. The apparatus of claim 13, wherein the computer verifies that said fluid intended to be dispensed was dispensed and that correct amounts of said fluid dispensed were actually dispensed.

15. An apparatus for dispensing a plurality of fluids, the apparatus comprising:

a plurality of pumps, a plurality of containers, a plurality of connectors, and a plurality of receptacles, each pump connected to a container by a connector;

at least some of the connectors being positioned above one of the a receptacles, the receptacles collecting fluid dripping from the connectors, a shared receptacle being positioned beneath the plurality of receptacles to collect said fluid dripping from the plurality of receptacles.

16. The apparatus of claim 15, wherein each receptacle comprises a lower wall, the lower walls of the receptacles being inclined and the lower walls comprising an opening for passing collected fluid down to the shared receptacle.

17. The apparatus according to claim 16, wherein a portion of each lower wall of the receptacle is funnel shaped.

18. The apparatus of claim 17, wherein the pumps and receptacles are mounted over a support and wherein the portion of the lower wall that is funnel-shaped extends through the support.

19. The apparatus of claim 15, wherein the shared receptacle comprises an inclined first surface, positioned beneath at least some of the receptacles, the inclined first surface comprising a lower rim connected to a raised edge, the lower rim and raised edge forming a first end of the inclined first surface, the shared receptacle further comprising an inclined second surface, positioned beneath the first end the inclined first surface.

20. The apparatus according to claim 19, wherein the inclined first surface comprises a second end disposed opposite the lower rim and raised edge from the first end, the shared receptacle further comprising an inclined third surface positioned beneath the second end of the inclined first surface.

21. The apparatus of claim 20, further comprising a drawer positioned below the inclined first, second and third surfaces.

22. The apparatus according to claim 21, wherein the pumps, connectors, and receptacles and shared receptacle are mounted on a turntable and arranged in a circle or part of a circle, the drawer being positioned beneath the inclined first, second and third surfaces, and wherein the inclined first, second and third surfrces of the shared receptacle follow the circumference of the said turntable such that said fluid dripping from any one of the receptacles will be collected by at least one of the inclined surfaces.

23. A container for use in the apparatus of claim 15, wherein the container is a bag-in-box container and at least part of an outer surface of the container is made of paper or cardboard.

24. A container for use in the apparatus of claim 15, wherein the container is a bag-in-box container, a connector-counterpart is fixed to the bag, the box comprises an opening for accommodating the connector-counterpart, the connector-counterpart comprises a rim comprising a groove or at least one recess, and wherein the rim of the opening in the box is positioned in the said groove or at least one recess.

25. An apparatus for dispensing a plurality of fluids, the apparatus comprising:

a support, and a plurality of pumps, each pump connected to a container or having a connector for releasably connecting a container to said each pump, and, a guide for receiving and accommodating a container mounted on the support, or guide is formed as a module which, a plurality of sent modules, each module comprising one pump, one connector, one container, and one guide, said each module, the modules comprising a font portion and a rear portion, the rear portion of said each module comprising first half of a releasable connection selected from the group consisting of an extension and a recess, the support comprising second halves of the releasable connections selected from the group consisting of a plurality recesses for receiving extensions of said modules, a plurality of extensions for engaging rececesses of said modules and combinations thereof.

26. The apparatus of claim 25, wherein the rear portion of said each module comprises an extention extending below the module and beyond the rear portion thereof, whereas the support comprises a plurality of recesses, each recess for receiving one of the extentions.

27. The apparatus according to claim 25, wherein at least some of the pumps comprise an actuator for releasing said container from the connector and wherein the actuator is part of the modules.

28. The apparatus according to claim 25, wherein a receptacle is positioned beneath or around at least some of the connectors to collect fluid leaking or dripping from a said container and wherein the receptacle is part of the modules.

29. The apparatus of claim 25, wherein the modules are mounted on a turntable and arranged in a circle or part of a circle.

30. The apparatus of claim 29, further comprising a weighing device disposed tangentially to the turntable but vertically below the turntable, the weighing device providing a surface for supporting a product container to be at least partially filled with at least some of the plurality of fluids, the weighing device measuring a weight of each fluid dispensed into the product container.

31. The apparatus of claim 30, wherein the weighing device communicates signals indicative of the weight of said each fluid dispensed into the product container to a computer.

32. The apparatus of claim 31, wherein the computer verifies that said each fluid intended to be dispensed was dispensed and that correct amounts of said each fluid dispensed into the computer were actually dispensed.

33. A container for use in the apparatus of claim 25, wherein the container is a bag-in-box container and at least part of an outer surface of the container is made of paper or cardboard.

34. A container for use in the apparatus of claim 25, wherein the container is a bag-in-box container, a connector-counterpart is fixed to the bag, the box comprises an opening for accommodating the connector-counterpart, the connector-counterpart comprises a rim comprising a groove or at least one recess, and wherein the rim of the opening in the box is positioned in the said groove or at least one recess.

35. An apparatus for dispensing a plurality of fluids, comprising;

a turntable and a plurality of pumps, each pump is connected to a container or having a connector for releasably connecting said container to said each pump, the pumps and containers or connectors being mounted on the turntable arranged along the circumference of the turntable or part of the circumference of the turntable, wherein at least one of the containers has a larger volume and is positioned towards a center of the turntable.

36. The apparatus of claim 35, wherein the containers comprise a front portion and a rear portion, the front portion being positioned at or near the circumference of the turntable.

37. The apparatus of claim 35, comprising two or more larger containers, which are substantially evenly distributed, either individually or group wise, over the circumference of the turntable.

38. The apparatus of claim 35, comprising two or more larger containers containing a developer of different concentrations.

39. The apparatus of claim 38, wherein the concentrations of the developer are in a range from 0 to 20 percent.

40. The apparatus of claim 35, wherein the at least one larger container comprises a front portion and a rear portion and wherein a filler opening is provided in at least the front portion.

41. A container for use in the apparatus of claim 35, wherein the container is a bag-in-box container and at least part of an outer surface of the container is made of paper or cardboard.

42. A container for use in the apparatus of claim 35, wherein the container is a bag-in-box container, a connector-counterpart is fixed to the bag, the box comprises an opening for accommodating the connector-counterpart, the connector-counterpart comprises a rim comprising a groove or at least one recess, and wherein the rim of the opening in the box is positioned in the said groove or at least one recess.

43. The apparatus of claim 35, further comprising a weighing device disposed tangentially to the turntable but vertically below the turntable, the weighing device providing a surface for supporting a product container to be at least partially filled with at least some of the plurality of fluids, the weighing device measuring a weight of each fluid dispensed into the product container.

44. The apparatus of claim 43, wherein the weighing device communicates signals indicative of the weight of said each fluid dispensed into the product container to a computer.

45. The apparatus of claim 43, wherein the computer verifies that said each fluid intended to be dispensed was dispensed and that correct amounts of said each fluid dispensed into the computer were actually dispensed.

46. A method of dispensing a recipe comprising a plurality of fluids from a dispensing apparatus comprising a plurality of pumps, each pump connected to a container holding one of said fluids, the apparatus further comprising a weighing device for measuring a weight of each fluid dispensed by the pumps, and a computer having a memory with a plurality of recipes stored therein, the method comprising:

selecting a recipe;

said each fluid of the recipe, dispensing said each fluid from said each pump and weighing an amount of said each fluid dispensed by said each pump and confirming that a correct amount of said each fluid was dispensed.

* * * * *

UNITED STATES PATENT AND TRADEMARK OFFICE

CERTIFICATE OF CORRECTION

PATENT NO. : 7,347,344 B2
APPLICATION NO. : 10/694485
DATED : March 25, 2008
INVENTOR(S) : Engels et al.

It is certified that error appears in the above-identified patent and that said Letters Patent is hereby corrected as shown below:

Column 10, Line 44: replace “measurements” with --measurement--

Column 10, Line 63: delete “a”

Column 11, Line 33: replace “surfrces” with --surfaces--

Column 11, Line 56: delete “sent”

Column 11, Line 59: replace “font” with --front--

Signed and Sealed this

Tenth Day of February, 2009

JOHN DOLL
*Acting Director of the United States Patent and Trademark Office*